United States Patent [19]

Stauder et al.

[11] Patent Number: 4,548,850

[45] Date of Patent: Oct. 22, 1985

[54] PILE FABRIC WITH PILE-FREE POSITIONS

[75] Inventors: Ernst Stauder, Viersen; Gerhard Hoffe, Monchen-Gladbach, both of Fed. Rep. of Germany

[73] Assignee: Johs. Girmes & Co. AG, Grefrath, Fed. Rep. of Germany

[21] Appl. No.: 694,925

[22] Filed: Jan. 25, 1985

[30] Foreign Application Priority Data

Jan. 31, 1984 [DE] Fed. Rep. of Germany ..... 3403184

[51] Int. Cl.[4] ..... B32B 3/02

[52] U.S. Cl. ..... 428/88; 428/95; 428/218; 428/225; 428/229; 428/257

[58] Field of Search ..... 428/88, 95, 225, 257, 428/226, 229, 232, 218

[56] References Cited

U.S. PATENT DOCUMENTS

| | | | |
|---|---|---|---|
| 2,472,511 | 6/1949 | Benthall | 428/95 |
| 2,482,581 | 9/1949 | Flynn | 428/93 |
| 3,017,847 | 1/1962 | Keen | 428/93 |
| 4,078,110 | 3/1978 | Fletcher et al. | 428/95 |

*Primary Examiner*—James J. Bell

*Attorney, Agent, or Firm*—Merchant, Gould, Smith, Edell, Welter & Schmidt

[57] ABSTRACT

A pile fabric with a woven substrate and a pile which is tied into the substrate at points is provided in the region of the pile-free positions with additional threads of decorative yarn which give the material an appearance which is unknown and untypical for pile fabrics.

19 Claims, 1 Drawing Figure

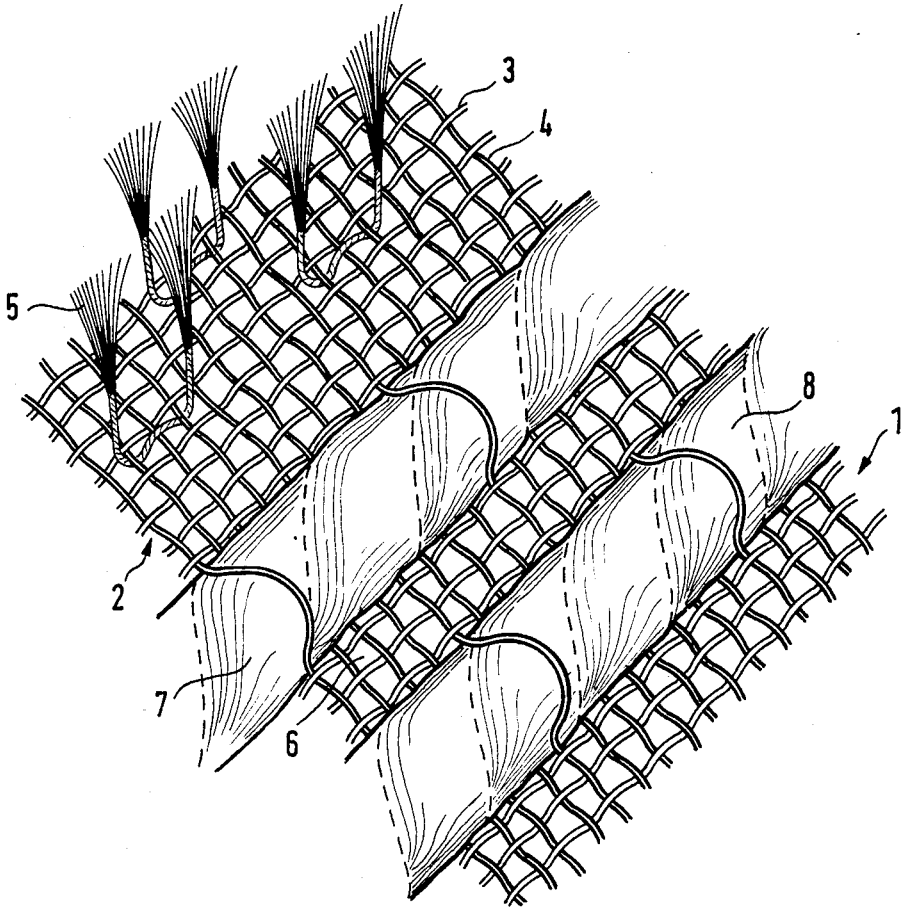
3
4
5
8
1
2
7
6

PILE FABRIC WITH PILE-FREE POSITIONS

The invention relates to a pile fabric with woven substrate and a pile woven into it at intervals so that the pile fabric has pile-free positions. In known pile fabrics of this kind the pile-free positions serve primarily to make the pile-carrying positions stand out, without themselves being a significant element in the surface of the goods.

The invention is based on solving the problem of providing a pile fabric with pile-free positions, in which the pile-free positions have a significant influence on the appearance of the pile fabric so that a pile fabric of novel appearance and character is obtained.

This problem is solved according to the invention in that the pile fabric contains additional threads at least in the region of the pile-free positions, influencing its appearance to a significant extent. In the region of the pile-free positions special threads are provided on the substrate, which in conjunction with the pile-free positions of the woven substrate lend an appearance and a character overall which are hitherto unknown and untypical for pile fabrics. Such pile fabrics according to the invention could find use, for example, in the field of textiles in the home or outer clothing.

Preferably the additional special threads are arranged on the woven substrate so that they extend along the corresponding pile-free portions of the substrate in the warp or weft direction. Preferably the additional special threads are tied to the base fabric at points, for example in that individual warp and/or weft threads are woven over the additional threads.

In such an arrangement the additional special threads preferably lie parallel to the warp threads of the woven substrate or equally parallel to its weft threads. In this way they allow themselves to be secured to the woven substrate in the most advantageous and favourable manner in the region of the pile-free positions or sections.

The additional threads applied to the woven substrate in the region of the pile-free positions comprise for example bulked yarn, for example knitting yarn, chenille, packthreads or twine, ribbons or other decorative yarns. By a particular weaving of these threads into the woven substrate they stand out particularly well.

According to a further feature of the invention the yarn count or weft thread density in the region of the pile-free positions is different from that in the region of the pile-bearing positions. Preferably the weft thread density or thread count in the region of the pile-free positions of the woven substrate is smaller (coarser) than in the region of the pile-bearing positions.

By virtue of the threads specially provided according to the invention a knitted look can be achieved for example in pile-free longitudinal and/or transverse stripes, but with the quality characteristic of a woven fabric. The novel optical effect can additionally be influenced by selection of appropriate decorative yarns, by untying these additional threads and/or the density of the arrangement of these threads in the warp or weft direction.

A portion of a pile fabric web made according to the invention is diagrammatically illustrated in the drawing.

The pile fabric web 1 comprises a woven substrate 2 of interwoven warp threads 3 and weft threads 4. Secured in the woven substrate 2 in an orthodox manner are pile loops 5 forming a pile fabric.

In the drawing the pile loops 5 are provided on only a part of the woven substrate 2 and for reasons of illustration they are only shown in a minimum number. In the region of the foreground in the drawing there is a pile-free position which extends in the longitudinal direction of the pile fabric web 1.

In the pile-free positions 6, parallel to one another, there are arranged on the woven substrate 2 bulked decorative yarns 7 and 8. These decorative yarns 7 and 8 are retained on the upper surface of the woven substrate with the aid of individual, but not all, weft threads 4. The corresponding weft threads are woven into the base fabric or woven substrate 2 in a manner such they float over several warp threads, on account of the volume of the decorative yarns 7 and 8, so that they do not constrict the decorative yarns 7 and 8 but simply retain them on the upper surface of the woven substrate 2 in the region of the pile-free positions 6.

We claim:

1. A pile fabric comprising a woven substrate comprising warp threads aligned in a warp direction and weft threads aligned in a weft direction, an operatively bound pile component in a pile-bearing position, and a plurality of additional decorative threads in a pile-free position, whereby said additional decorative threads significantly affect the appearance of said pile fabric.

2. A pile fabric according to claim 1, wherein said additional decorative threads extend along said warp direction of said pile fabric.

3. A pile fabric according to claim 1, wherein said additional decorative threads extend along said weft direction of said pile fabric.

4. A pile fabric according to claim 1, wherein a first portion of said additional decorative threads extend along said warp direction and a second portion of said additional decorative threads extend along said weft direction.

5. A pile fabric according to claim 2, wherein said additional decorative threads are tied at selected intervals into said woven substrate.

6. A pile fabric according to claim 3, wherein said additional decorative threads are tied at selected intervals into said woven substrate.

7. A pile fabric according to claim 4, wherein said additional decorative threads are tied at selected intervals into said woven substrate.

8. A pile fabric according to claim 2, wherein said additional decorative threads lie on said woven substrate parallel to said warp direction.

9. A pile fabric according to claim 3, wherein said additional decorative threads lie on said woven substrate parallel to said weft direction.

10. A pile fabric according to claim 4, wherein said first portion of said additional decorative threads lie on said woven substrate parallel to the warp direction and said second portion of said additional decorative threads lie on said woven substrate parallel to the weft direction.

11. A pile fabric according to claim 2, wherein said additional decorative threads are of bulked yarn.

12. A pile fabric according to claim 3, wherein said additional decorative threads of bulked yarn.

13. A pile fabric according to claim 4, wherein said additional decorative threads of bulked yarn.

14. A pile fabric according to claim 2, wherein said woven substrate has a first thread density in said pile-bearing portion, and a second thread density in said pile-free portion, wherein said first thread density is different from said second thread density.

15. A pile fabric according to claim 3, wherein said woven substrate has a first thread density in said pile-bearing portion, and a second thread density in said pile-free portion, wherein said first thread density is different from said second thread density.

16. A pile fabric according to claim 4, wherein said woven substrate has a first thread density in said pile-bearing portion, and a second thread density in said pile-free portion, wherein said first thread density is different from said second thread density.

17. A pile fabric according to claim 14, wherein said first thread density is larger than said second thread density.

18. A pile fabric according to claim 15, wherein said first thread density is larger than said second thread density.

19. A pile fabric according to claim 16, wherein said first thread density is larger than said second thread density.

* * * * *